US009133540B2

(12) United States Patent
Jang et al.

(10) Patent No.: US 9,133,540 B2
(45) Date of Patent: Sep. 15, 2015

(54) APPARATUS FOR REMOVING POLLUTANT SOURCE FROM SNOUT OF GALVANIZING LINE

(75) Inventors: Tae-In Jang, Gwangyang-si (KR); Yong-Hun Kweon, Gwangyang-si (KR); Jung-Kuk Kim, Gwangyang-si (KR); Chang-Woon Jee, Gwangyang-si (KR)

(73) Assignee: POSCO, Pohang-si (KR)

( * ) Notice: Subject to any disclaimer, the term of this patent is extended or adjusted under 35 U.S.C. 154(b) by 47 days.

(21) Appl. No.: 13/824,574

(22) PCT Filed: Dec. 26, 2011

(86) PCT No.: PCT/KR2011/010117

§ 371 (c)(1),
(2), (4) Date: Mar. 18, 2013

(87) PCT Pub. No.: WO2012/091391

PCT Pub. Date: Jul. 5, 2012

(65) Prior Publication Data

US 2013/0180076 A1 Jul. 18, 2013

(30) Foreign Application Priority Data

Dec. 27, 2010 (KR) ..... 10-2010-0136123

(51) Int. Cl.

| | |
|---|---|
| ***C23C 2/00*** | (2006.01) |
| ***B05C 3/02*** | (2006.01) |
| *B05C 3/00* | (2006.01) |

(52) U.S. Cl.
CPC . *C23C 2/003* (2013.01); *C23C 2/00* (2013.01); *B05C 3/005* (2013.01); *B05C 3/02* (2013.01)

(58) Field of Classification Search
None
See application file for complete search history.

(56) References Cited

U.S. PATENT DOCUMENTS

| | | | | |
|---|---|---|---|---|
| 5,505,857 | A * | 4/1996 | Misra et al. | 210/709 |
| 6,458,282 | B1 * | 10/2002 | Lundback | 210/776 |
| 2011/0050016 | A1 * | 3/2011 | Jang et al. | 310/90.5 |

FOREIGN PATENT DOCUMENTS

| | | | | |
|---|---|---|---|---|
| JP | 59-159978 | | 9/1984 | |
| JP | 2000212714 | A | 2/2000 | |
| KR | 1020010057267 | * | 7/2001 | C23C 2/06 |
| KR | 1020010057267 | A | 7/2001 | |
| KR | 1020030049330 | A | 6/2003 | |
| KR | 1020030050080 | * | 6/2003 | C23C 2/06 |
| KR | 100815819 | B1 | 3/2008 | |

* cited by examiner

*Primary Examiner* — Dah-Wei D Yuan
*Assistant Examiner* — Jethro M Pence
(74) *Attorney, Agent, or Firm* — The Webb Law Firm

(57) ABSTRACT

Provided is an apparatus for efficiently removing a pollutant source in a snout of a steel plating line such as a steel galvanizing line. The pollutant removing apparatus includes at least one pollutant collecting member connecting to a snout between a heating furnace and a plating tank, and a contact-free inducer varying magnetic field within the snout to forcibly guide, without contact, a pollutant source of a steel plate or a processing unit to the pollutant collecting member.

10 Claims, 7 Drawing Sheets

APPARATUS FOR REMOVING POLLUTANT SOURCE FROM SNOUT OF GALVANIZING LINE

TECHNICAL FIELD

The present invention relates to an apparatus for efficiently removing a pollutant source from a snout of a steel plating line such as a steel galvanizing line, and more particularly, to an apparatus that uses induction current to apply drag force and levitation force to zinc ash including zinc or zinc oxide as a diamagnetic substance, or to dross formed on the surface of a plating solution, thereby efficiently removing a pollutant source from a steel plate or a processing unit. In addition, inner atmospheric conditions of the snout can be stably maintained by appropriately (optimally) collecting the pollutant source. As a result, zinc ash or dross can be effectively prevented from affecting a steel plate plating process, and polluting processing units.

BACKGROUND ART

Since plated steel plates, particularly, galvanized steel plates have excellent corrosion resistance, they are widely used not only as typical building materials and exterior parts of home appliances requiring a finished surface, but also for exterior of vehicle parts.

Specifically, recently popular color steel plates and hot-dip galvanized steel plates for home appliance interior and exterior parts and vehicles require excellent surface qualities as well as excellent corrosion resistance.

FIG. 1 is a schematic view illustrating a process of galvanizing a steel plate in the related art. Referring to FIG. 1, a steel plate 100 continuously discharged from a cold-rolled coil by a payoff reel (not shown) and a welder (not shown) is heat-treated in a heating furnace 110 to eliminate residual stress, and then, the heated steel plate 100 is maintained at proper temperature for galvanizing, and is introduced to a plating tank 130 filled with a plating solution, that is, molten zinc 130*a*.

A snout 120 connects the heating furnace 110 to the plating tank 130 to prevent the surface of the heated steel plate 100 from being oxidized by air. The snout 120 may be filled with inert gas as atmospheric gas to prevent plating defects due to surface oxidization.

After passing through the heating furnace 110, the snout 120, a sink roll 132 of the plating tank 130, and stabilizing rolls 134, a plating amount of the steel plate 100 is adjusted to a desired value by an air knife 140 disposed at the vertical upper side of the plating tank 130.

After that, the steel plate 100 passes through a skin pass mill (not shown), and surface roughness and shape are properly modified. Then, the steel plate 100 is cut by a cutter (not shown), and is rolled by a tension reel (not shown), to thereby obtain a final plated coil.

Referring to FIG. 2, evaporated zinc (curled arrows in FIG. 2) are processed to be zinc ash 130*b* deposited on the inner wall (inner surface) of the snout 120. When a deposited amount of the zinc ash 130*b* is over a predetermined threshold, the zinc ash 130*b* falls down and floats on the surface of the molten zinc 130*a*, and may be attached to the surface of the steel plate 100, thereby causing surface defects.

For example, such zinc ash may be formed by the evaporation and condensation of zinc, stagnation of atmospheric gas within a snout, and waves due to the movement of a steel plate into the surface of a plating solution, and is typically a Zn or ZnO compound.

Since zinc ash is a pollutant source for a steel plate, that is, a source of pollutants causing line defects and plating defects on the surface of a steel plate, zinc ash may be a serious defect in a high-grade galvanized product.

Various methods are introduced to reduce or prevent the production of zinc ash within a snout. For example, evaporation of zinc may be fundamentally prevented, the surface of molten zinc within a snout may be decreased, certain types of gas may be injected into a snout, or zinc ash or zinc vapor may be collected.

However, these methods have limitations in suppressing the evaporation of zinc to effectively prevent zinc ash from being deposited and grown on the inner wall of a snout.

Particularly, when zinc ash or zinc vapor is collected and removed, an atmospheric condition required within a snout may be jeopardized. In addition, a through collecting process is required to efficiently collect and remove zinc vapor or zinc ash from within a snout, and thus, operating costs may be increased. Moreover, in this case, zinc ash removing efficiency may be degraded.

Furthermore, a dross oxide may be formed by contact between atmospheric gas or air (oxygen) and the surface of molten zinc within a snout. A dross oxide may be difficult to efficiently remove using a typical method of collecting and removing zinc ash within a snout.

Moreover, a technology of using an induction current generated by time travelling magnetic flux that varies magnetic field, to apply drag force and levitation force to zinc ash or dross formed of zinc or zinc oxide as a diamagnetic substance, thereby forcibly guiding the zinc ash or dross to a suction line has not been disclosed.

SUMMARY OF THE INVENTION

An aspect of the present invention provides a pollutant removing apparatus which uses an induction current to apply drag force and levitation force to zinc ash including zinc or zinc oxide as a diamagnetic substance, or to dross formed on the surface of a plating solution, thereby efficiently removing a pollutant source from a steel plate or a processing unit. In addition, the pollutant source can be properly collected, and an inner atmospheric condition of a snout can be stably maintained. As a result, zinc ash or dross can be effectively prevented from affecting a steel plate plating process, and polluting processing units.

According to an aspect of the present invention, there is provided a pollutant removing apparatus including: at least one pollutant collecting member connecting to a snout between a heating furnace and a plating tank; and a contact-free inducer varying magnetic field within the snout to forcibly guide, without contact, a pollutant source of a steel plate or a processing unit to the pollutant collecting member.

The pollutant source may include zinc or zinc oxide as a diamagnetic substance to which at least one of drag force and levitation force according to induction current generated by applying alternating current to electromagnets or rotating permanent magnets is applied, and the pollutant collecting member may include a pollutant collecting pipe connected to the snout, and a suction line connected to the pollutant collecting pipe.

The contact-free inducer may be adjacent to a pollutant collecting pipe of the pollutant collecting member connected to the snout, and be disposed on at least one side of a fed steel plate to forcibly guide, without contact, at least one of zinc ash and dross as the pollutant source within the snout to the pollutant collecting pipe.

The contact-free inducer may be adjacent to a pollutant collecting pipe of the pollutant collecting member connected to the snout, and be provided in plurality in a multi-stage on at least one side of a fed steel plate to forcibly guide, without contact, at least one of zinc ash and dross as the pollutant source within the snout to the pollutant collecting pipe.

The contact-free inducer disposed at least in a lower stage of the multistage may be adjacent to a surface of a plating solution, or be partially immersed in the plating solution to forcibly guide, without contact, at least the dross as the pollutant source within the snout to the pollutant collecting pipe.

The contact-free inducer may include a first contact-free inducer that includes permanent magnets having different poles and alternately disposed around a rotator to forcibly guide, without contact, at least one of zinc ash and dross as the pollutant source within the snout to the pollutant collecting pipe of the pollutant collecting member.

The rotator of the first contact-free inducer may include: a rotation shaft that passes through the snout in a width direction of a steel plate and is rotated by a driving motor; and a rotary block coupled to the rotation shaft and including a permanent magnet installation part on which the permanent magnets having different poles are alternately installed.

The contact-free inducer may include a second contact-free inducer that includes electromagnets to which single-phase or three-phase alternating current is applied to form time travelling magnetic flux, to forcibly guide, without contact, at least one of zinc ash and dross as the pollutant source within the snout to the pollutant collecting pipe of the pollutant collecting member.

The second contact-free inducer may include: a hollow support passing through the snout in a width direction of a steel plate, the electromagnets being arrayed around the hollow support; and a pulse width modulator connected to the electromagnets through a cable within the hollow support.

The pollutant removing apparatus may further include at least one of a guide plate disposed in the snout near an inlet of the pollutant collecting pipe of the pollutant collecting member; and an insulating cover surrounding the contact-free inducer with a certain space therebetween to protect the contact-free inducer from a steel plate or a processing unit.

The pollutant removing apparatus may further include at least a first shield plate connected to the snout between the contact-free inducers disposed in a multi-stage manner within the snout, and may further include a second shield plate disposed at an end of the first shield plate and extending in a passing direction of a steel plate.

The suction line of the pollutant collecting member may be provided with a flow rate sensor that senses a flow rate of a collected pollutant source, and that connects to an apparatus control unit, and the apparatus control unit may be connected to a driving motor adjacent to a first contact-free inducer constituting the contact-free inducers, and a pulse width modulator adjacent to a second contact-free inducer constituting the contact-free inducers, to control an operation of the contact-free inducers according to a collected amount of a pollutant source.

It should be noted that the above description does not cover all the features of the present invention. Various features of the present invention and advantages and effects arising therefrom will be understood in more detail with reference to the detailed embodiments below.

According to the embodiments, when permanent magnets are rotated, or an alternating current is applied to electromagnets, time travelling magnetic flux generates induction current to forcibly guide, without contact, zinc ash or dross as a diamagnetic pollutant source from a snout to pollutant collecting members, thereby efficiently preventing the zinc ash or dross from polluting a steel plate or a processing unit.

That is, according to the embodiments of the present invention, zinc ash or dross, which would otherwise pollute a steel plate or a processing unit, can be stably removed to ensure a clean state within a snout.

Thus, the plating quality of a steel plate can be stably maintained by removing zinc ash or dross as a pollutant source of the steel plate. Specifically, since drag force and levitation force forcibly guide a pollutant source to a suction line, without contact, it is unnecessary to remove an addition pollutant source formed due to contact.

Accordingly, a steel plate used in vehicles requiring high plating quality can be formed.

BRIEF DESCRIPTION OF DRAWINGS

The above and other aspects, features and other advantages of the present invention will be more clearly understood from the following detailed description taken in conjunction with the accompanying drawings, in which.

MODE FOR THE INVENTION

Figure 1:
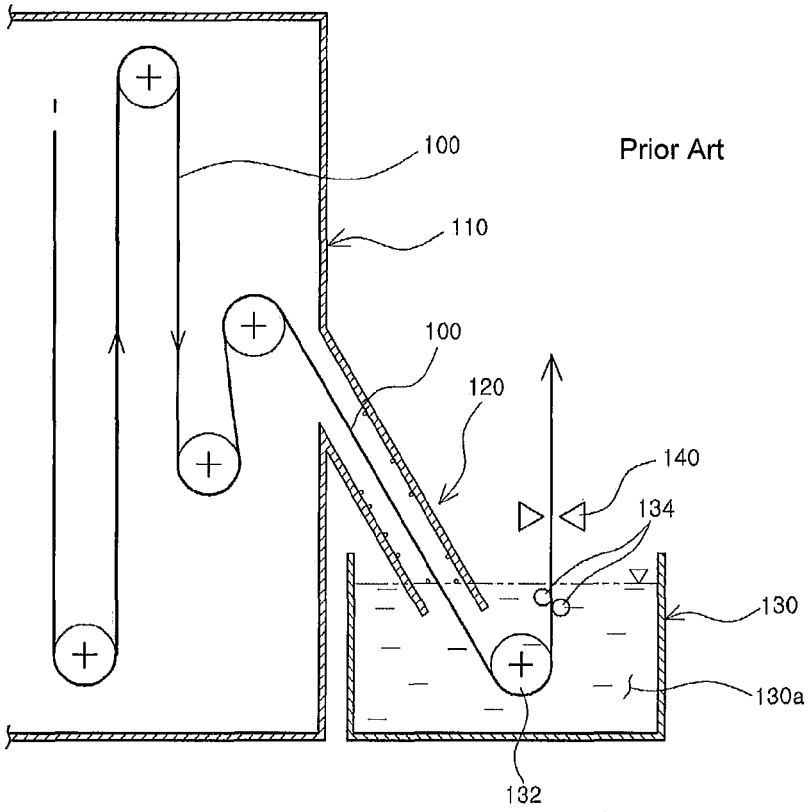
FIG. 1 is a schematic view illustrating a process of galvanizing a steel plate in the related art.
Figure 2:
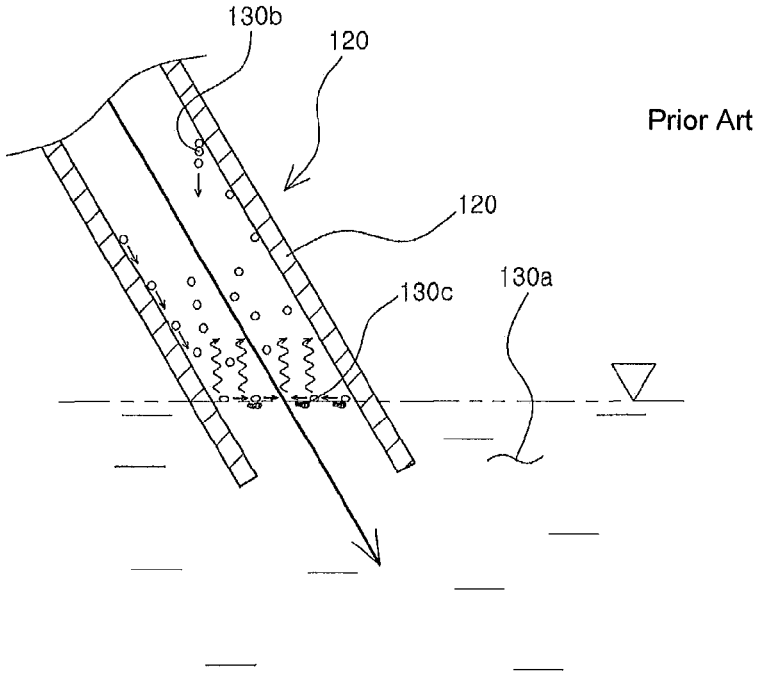
FIG. 2 is a schematic view illustrating zinc ash formed within a snout in the related art.

Exemplary embodiments of the present invention will now be described in detail with reference to the accompanying drawings. The accompanying drawings are exemplary drawings used to describe the exemplary embodiments of the present invention, and thus, the present invention is not limited thereto. In the drawings, the dimensions of components and regions may be exaggerated for clarity of illustration.

Figure 3:
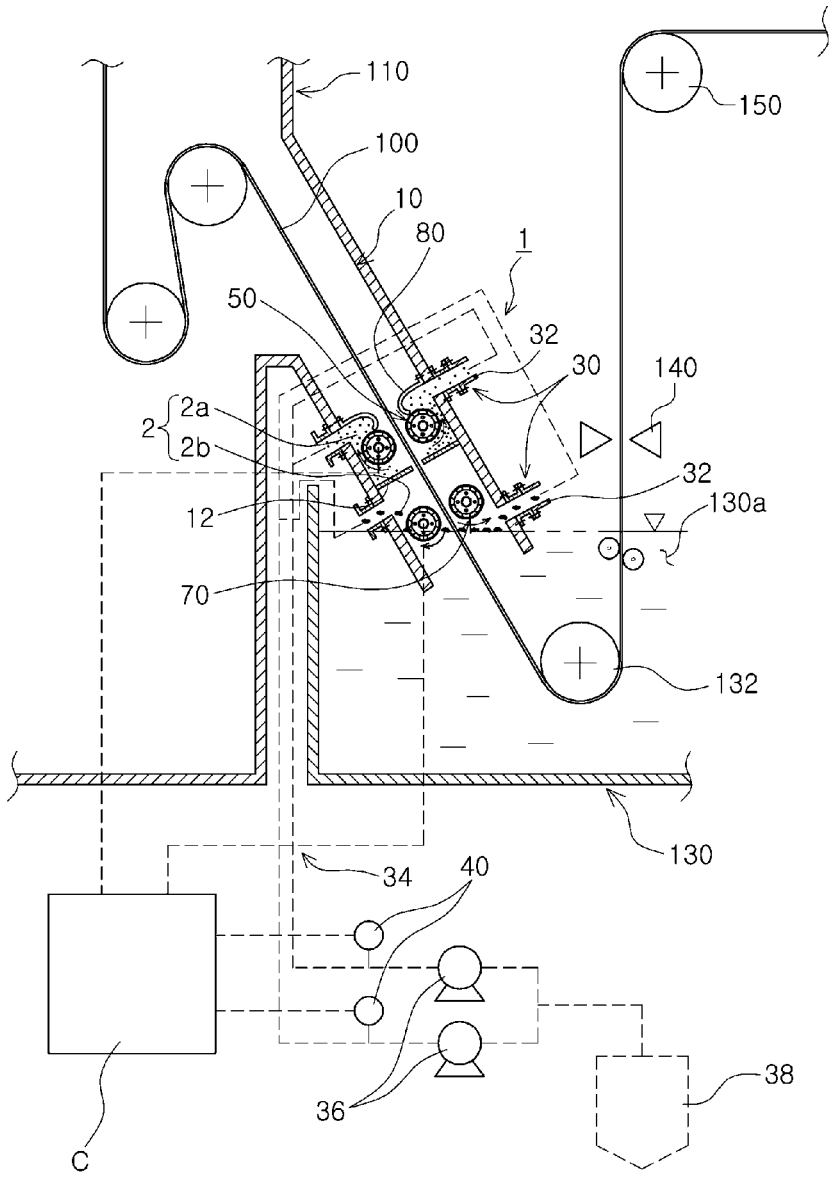
FIG. 3 is a schematic view illustrating a pollutant removing apparatus according to an embodiment of the present invention.
Figure 4:
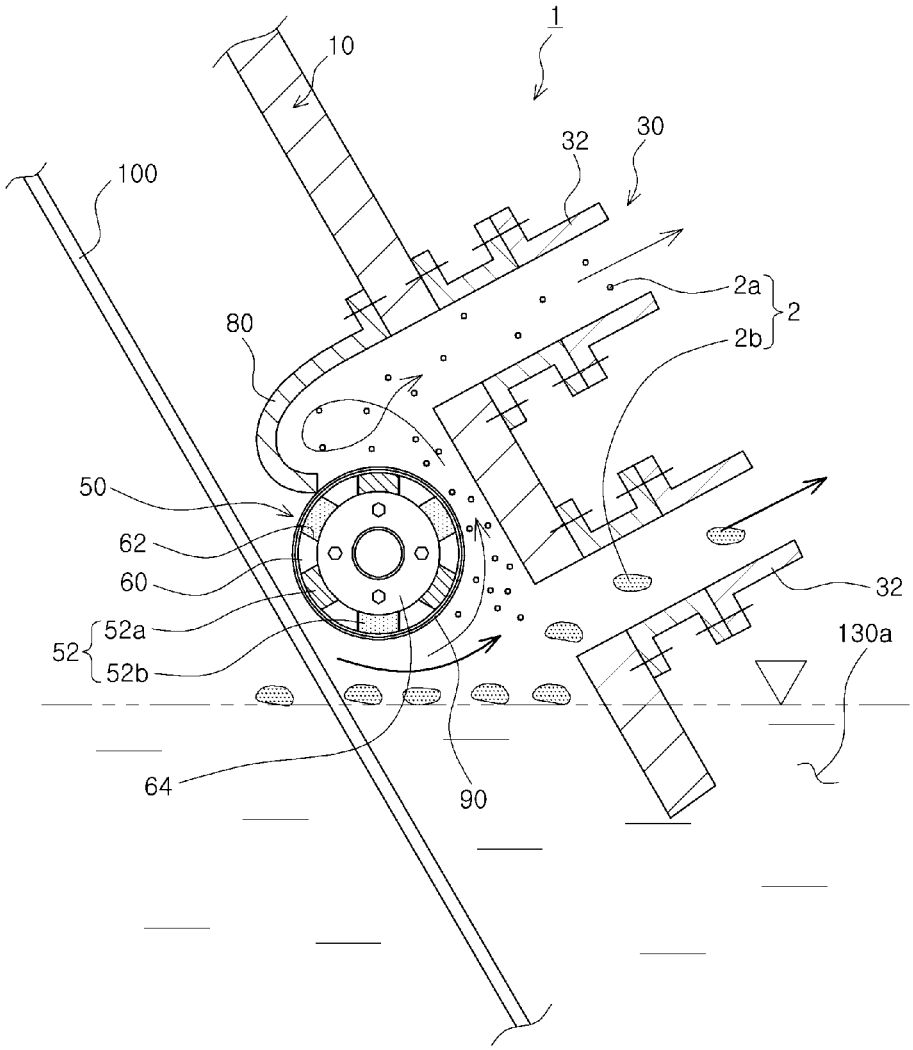
FIG. 4 is a schematic view illustrating a contact-free inducer of a pollutant removing apparatus according to an embodiment of the present invention.

FIGS. 3 and 4 are schematic views illustrating a pollutant removing apparatus 1 for removing a pollutant source in a snout of a galvanizing line, according to an embodiment of the present invention.

In the current embodiment, a galvanizing line is exemplified as a plating line, and a galvanized steel plate 100 is exemplified as a plated steel plate. In addition, zinc ash 2*a* including zinc or zinc oxide formed within a snout, and dross 2*b* formed on the surface of a plating solution may be referred to as a pollutant source 2 of a steel plate or a processing unit.

Like reference numerals denote like elements in the related art of FIG. 1 and the current embodiment, three digit numbers, and snout elements are denoted by two digit numbers.

Referring to FIGS. 3 and 4, the pollutant removing apparatus 1 may include one or more pollutant collecting members 30 that connect to a snout 10 disposed between a heating furnace (annealing furnace) 110 and a plating tank 130; and a plurality of contact-free inducer 50 or 70 that vary magnetic field within the snout 10 to forcibly guide, without contact, a pollutant source of a steel plate or processing unit from the snout 10 to the pollutant collecting members 30.

Thus, the pollutant removing apparatus 1 including the contact-free inducers 50 and 70 within the snout 10 forcibly guides at least one of the zinc ash 2*a* and the dross 2*b* through pollutant collecting pipes 32 of the pollutant collecting members 30 to more efficiently remove it than a typical apparatus including a pollutant collecting pipe connected to a snout to simply collect a pollutant source such as zinc ash.

That is, the pollutant removing apparatus 1 can maximally remove the zinc ash 2*a* including zinc or zinc oxide formed within the snout 10, or the dross 2*b* formed by contact with air and the surface of a plating solution.

For example, the pollutant removing apparatus 1 may ensure a state of inner cleanliness of the snout 10 to prevent the zinc ash 2*a* or the dross 2*b* from being attached to the surface of a steel plate or a sink roll, thus preventing plating defects or surface defect of the steel plate, and a defect of processing units.

The contact-free inducers of the pollutant removing apparatus 1 use an induction current through time travelling magnetic flux that varies (electro) magnetic field over time, to simultaneously apply drag force and levitation force to pollutant sources, particularly, to zinc ash or dross formed of zinc or zinc oxide as a diamagnetic substance, thereby forcibly guiding, without contact, the zinc ash or dross to the pollutant collecting pipes 32 of the pollutant collecting members 30, which will later be described in greater detail. Thus, the pollutant sources can be more efficiently collected and removed.

That is, when single-phase or three-phase alternating current is applied to electromagnets within the snout 10, or when a permanent magnet is rotated, at least one of drag force and levitation force is applied to the zinc ash 2*a* or the dross 2*b* as the pollutant source 2 that is a diamagnetic substance, thereby forcibly and efficiently guiding the pollutant source 2 to the pollutant collecting pipes 32.

Figure 5:
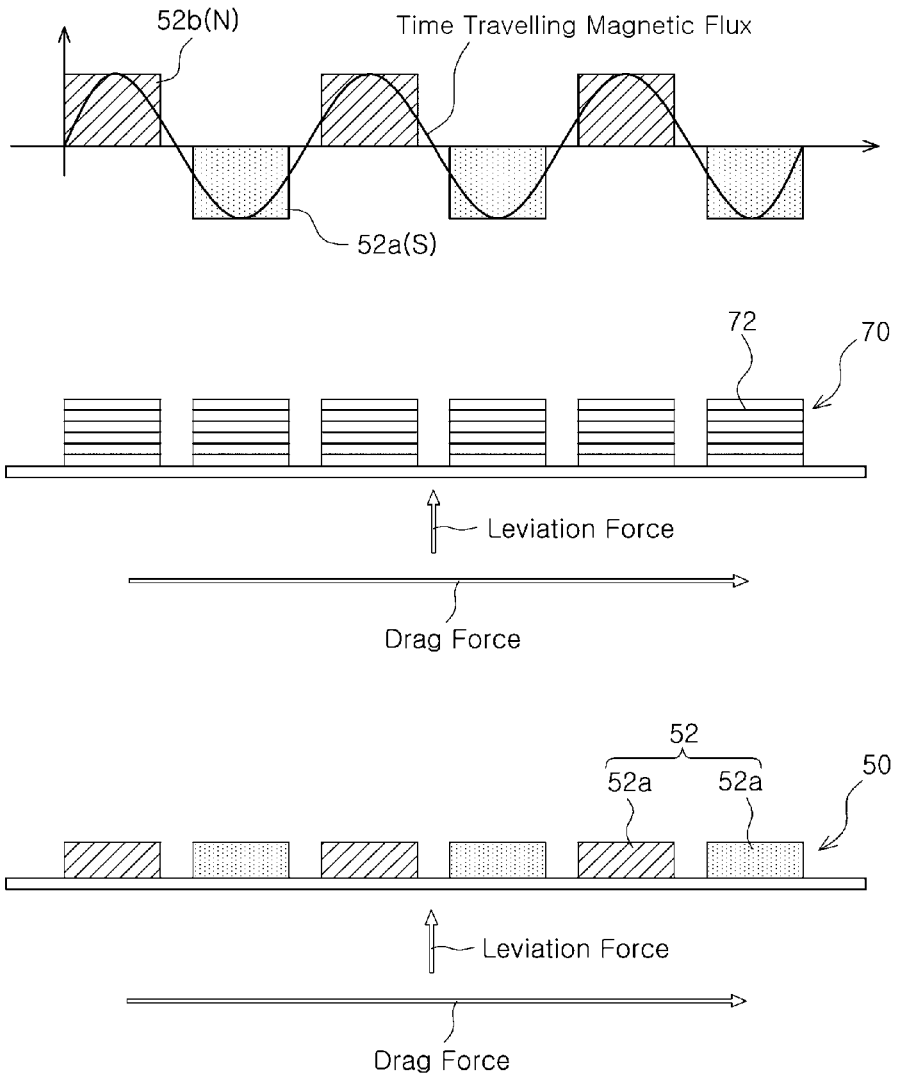
FIG. 5 is a schematic view illustrating drag force and levitation force generated by induction current according to time travelling magnetic flux in a pollutant removing apparatus according to an embodiment of the present invention.

Referring to FIG. 5, the contact-free inducers 70 are second contact-free inducers including electromagnets 72 to be described later, and the contact-free inducers 50 are first contact-free inducers including permanent magnets 52 having different poles, that is, a plurality of N pole permanent magnets 52*a* and a plurality of S pole permanent magnets 52*b* are alternately arrayed in the contact-free inducers 50.

According to a principle illustrated in FIG. 5, the first contact-free inducers 50 including the permanent magnets 52 and the second contact-free inducers 70 including the electromagnets 72 apply drag force and levitation force to the zinc ash 2*a* or the dross 2*b* as the pollutant source 2.

That is, as illustrated in the graph of FIG. 5, when the permanent magnets 52 including the alternately arrayed N pole permanent magnets 52*a* and S pole permanent magnets 52*b* are rotated, induction current is generated by time travelling magnetic flux that varies magnetic field with time, thereby applying drag force and levitation force to a diamagnetic substance such as zinc (Zn), aluminum (Al), or copper (Cu). In this case, the drag force is dominant until reaching a threshold rotation speed.

In addition, when a pulse width modulator 78 (refer to FIG. 10) applies alternating current to the electromagnets 72, drag force and levitation force are applied to a diamagnetic substance as described above. At this point, the alternating current has a certain magnitude to apply the levitation force.

That is, the drag force and the levitation force can be controlled by adjusting torque applied to the permanent magnets 52, and the levitation force can be formed and controlled by applying a certain magnitude of alternating current to the electromagnets 72.

Referring again to FIGS. 3 and 4, the pollutant collecting members 30 may include the pollutant collecting pipes 32 connected to the snout 10, and suction lines 34 connected to the pollutant collecting pipes 32.

For example, referring to FIG. 3, when the contact-free inducers 50 or 70 are vertically arrayed, the pollutant collecting pipes 32 may be installed near the contact-free inducers 50 or 70 at both sides of the snout 10 (alternatively, the contact-free inducers 50 and 70 may be installed near the pollutant collecting pipes 32), and pumps 36 for collecting the dross 2*b* formed on the surface of the plating solution and the zinc ash 2*a* above the snout 10 may be connected to the pollutant collecting pipes 32.

The suction lines 34 passing through the pumps 36 may be connected to a collecting tank 38 for collecting and recycling the zinc ash 2*a* and the dross 2*b*. Flow rate sensors 40 are provided to the suction lines 34, respectively, to sense the amount of the zinc ash 2*a* and the dross 2*b* as the pollutant source 2.

Figure 10:
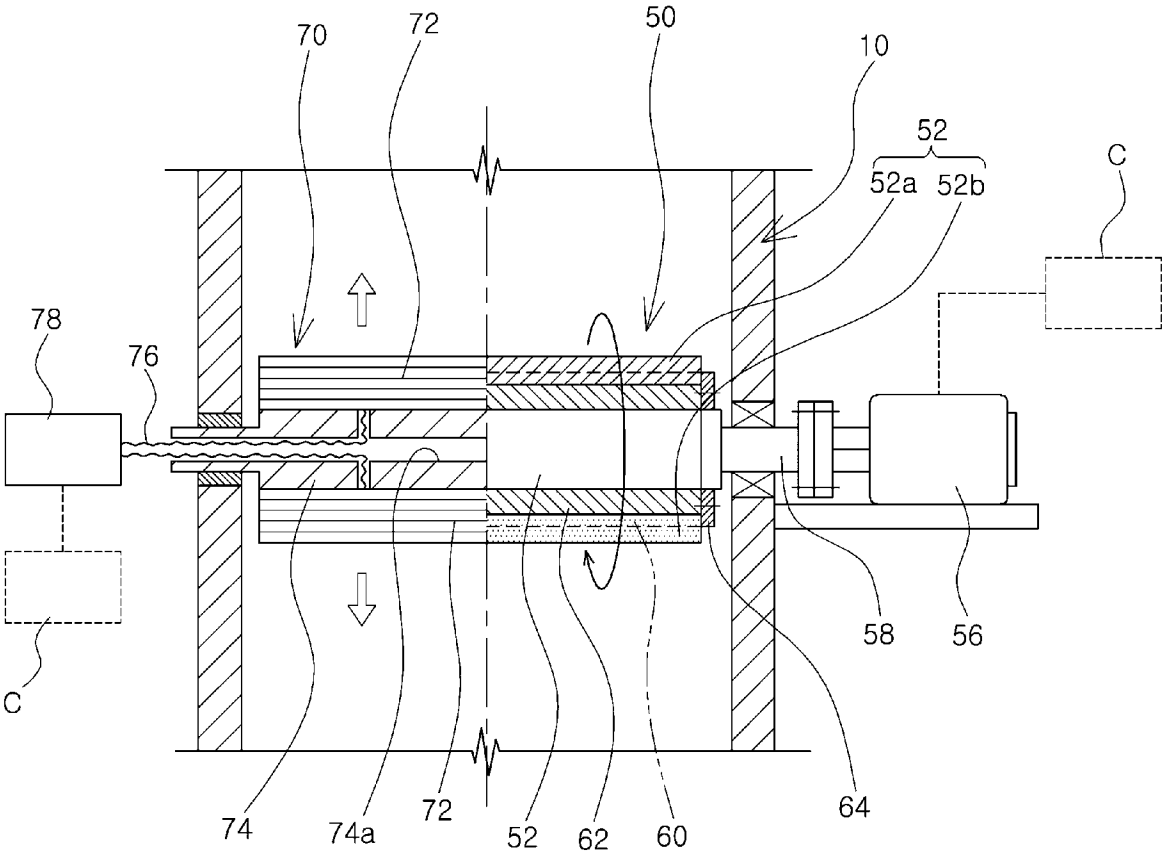
FIG. 10 is a schematic view illustrating first and second contact-free inducers including permanent magnets and electromagnets according to an embodiment of the present invention.

The flow rate sensors 40 are connected to an apparatus control unit C, and the apparatus control unit C is connected to a driving motor 56 adjacent to the first contact-free inducers 50, or the pulse width modulator 78 adjacent to the second contact-free inducers 70 to apply alternating current to the electromagnets 72 as illustrated in FIG. 10. Thus, an operation of the first contact-free inducers 50 or the second contact-free inducers 70 can be controlled according to a collected amount of the pollutant source 2.

For example, when torque applied to the permanent magnets 52 is increased, drag force and levitation force may be increased. In addition, drag force and levitation force may be adjusted by controlling alternating current applied to the electromagnets 72.

Thus, as illustrated in FIGS. 3 and 4, the first contact-free inducers 50 or the second contact-free inducers 70 are adjacent to the pollutant collecting pipes 32 of the pollutant collecting members 30 connected to the snout 10, and are disposed on at least both sides of a fed steel plate, to forcibly guide at least one of the zinc ash 2*a* and the dross 2*b* as the pollutant source 2 formed within the snout 10, to the pollutant collecting pipes 32 and efficiently remove it.

When the first contact-free inducers 50 or the second contact-free inducers 70 rotate, drag force is formed along the circumference of the first contact-free inducers 50 or the second contact-free inducers 70, so as to drag, without contact, at least one of the zinc ash 2*a* and the dross 2*b* as the pollutant source 2 to the pollutant collecting pipes 32.

Until the first contact-free inducers 50 including the permanent magnets 52 reach the threshold rotation speed, drag force is dominant. Thus, the first contact-free inducers 50 may be disposed at the upper side of the snout 10 where the zinc ash 2*a* formed by condensation of zinc evaporated within the snout 10 is mainly collected, and the second contact-free inducers 70 including the electromagnets 72 to form drag force and levitation force according to the magnitude of single-phase or three-phase alternating current applied from the pulse width modulator 78 may be disposed at the lower side of the snout 10, that is, near the surface of the plating solution to forcibly guide and remove the dross 2*b* from the surface of the plating solution.

For example, as illustrated in FIG. 4, when the first contact-free inducer 50 including the permanent magnets 52, that is, the alternately arrayed N pole permanent magnets 52*a* and S pole permanent magnets 52*b* rotate, drag force and levitation force are applied to a diamagnetic substance. Accordingly, the zinc ash 2*a* formed by condensation of zinc vapor is collected to the pollutant collecting pipe 32 by the drag force (depicted with arrows), and the dross 2*b* formed on the surface of the plating solution is collected to the pollutant collecting pipe 32 by the drag force and the levitation force.

That is, the first contact-free inducer 50 including the permanent magnets 52 mainly generates drag force until reaching the threshold rotation speed, and the second contact-free inducer 70 including the electromagnets 72 generates drag force and levitation force when alternating current is applied thereto (through pulse width modulation). Thus, the second contact-free inducer 70 removes the dross 2*b* formed on the plating surface more efficiently than the zinc ash 2*a* illustrated in FIG. 4.

Figure 7:
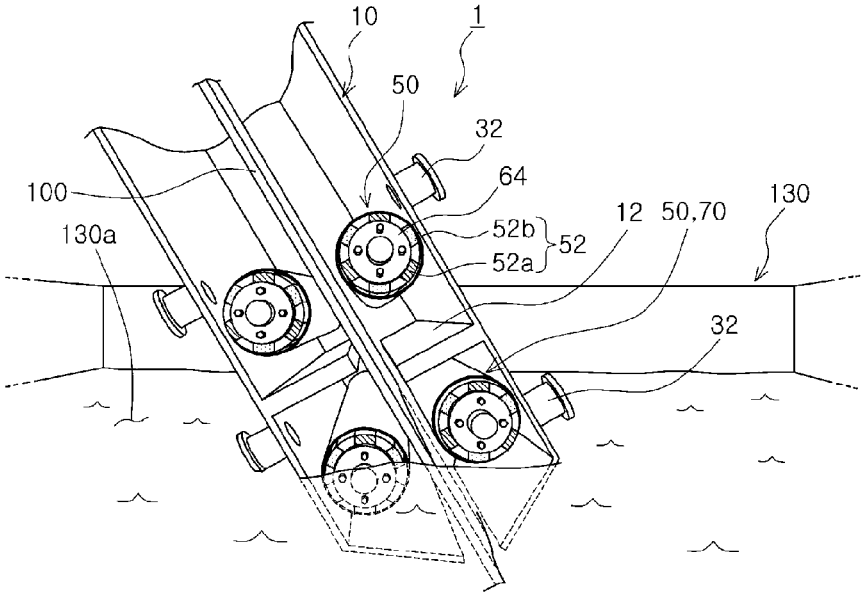
FIG. 7 is a perspective view illustrating a state in which the contact-free inducers of FIG. 6 are installed in a multi-stage.

For example, referring to FIGS. 3 and 7, since the dross 2*b* has a grain size larger than that of the zinc ash 2*a*, the first or second contact-free inducers 50 or 70 may be partially immersed in the plating solution to efficiently guide the dross 2*b* to the pollutant collecting pipes 32. In this case, the second contact-free inducers 70 including the electromagnets 72 do not require torque, so as to prevent waves from being formed on the surface of the plating solution, which will be described with reference to FIG. 10.

Alternatively, as illustrated in FIG. 4, only the first contact-free inducers 50 including the permanent magnets 52 may be used to forcibly guide the zinc ash 2*a* and the dross 2*b* as the pollutant source 2, by disposing the first contact-free inducers 50 near the surface of the plating solution without immersing the first contact-free inducers 50 in the plating solution, and disposing the pollutant collecting pipes 32 at the upper and lower sides of the first contact-free inducers 50.

Furthermore, as illustrated in FIGS. 3 and 4, guide plates 80 for guiding the pollutant source 2 may be disposed within the snout 10.

That is, the front end of the guide plates 80 is bended to form an arc guide space. Thus, when the permanent magnets 52 of the first contact-free inducer 50 rotate to apply drag force to the zinc ash 2*a*, the front end of the guide plate 80 more efficiently guides the zinc ash 2*a* to the pollutant collecting pipe 32.

Furthermore, when the first contact-free inducers 50 rotate, the guide plates 80 prevent drag force formed in the circumferential direction of the first contact-free inducers 50 to prevent the zinc ash 2*a* to be scattered to a fed steel plate.

Thus, the guide plates 80 may be bent to be close to insulating covers 90 disposed at the peripheries of the first contact-free inducers 50 with a certain space therebetween, thereby substantially collecting all of the zinc ash 2*a* to the pollutant collecting pipes 32.

Figure 6:
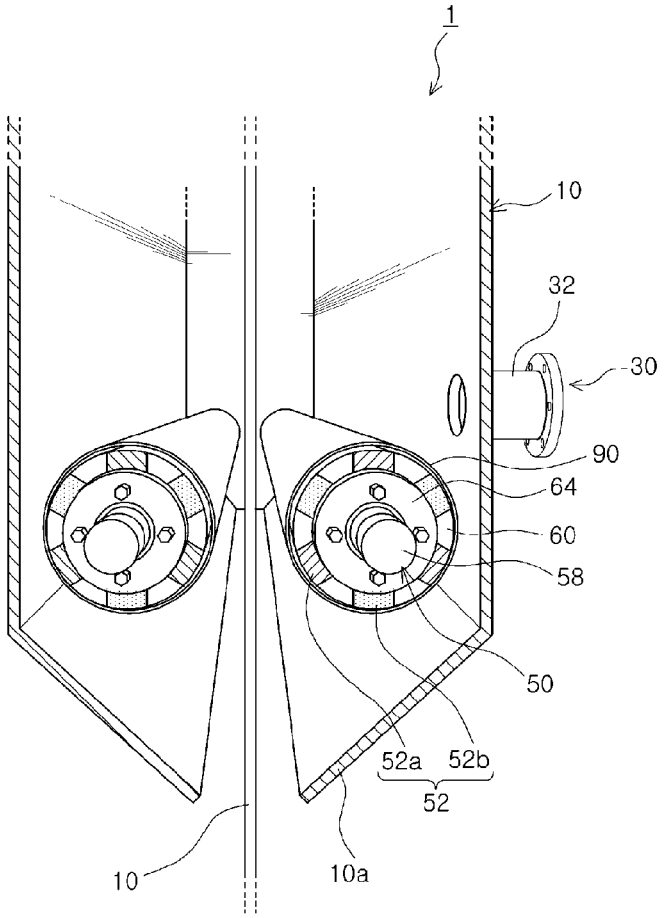
FIG. 6 is a perspective view illustrating contact-free inducers installed on a pollutant removing apparatus according to an embodiment of the present invention.

FIGS. 6 and 7 are perspective views illustrating states in which the first and second contact-free inducers 50 and 70 of FIGS. 3 and 4 are installed on the snout 10. Referring to FIG. 7, the first and second contact-free inducers 50 or 70 are selectively disposed at the lower side of the snout 10.

For example, the pollutant removing apparatus 1 may include at least one of the first and second contact-free inducers 50 and 70, and be connected to the lower side of a typical snout, as illustrated in FIGS. 6 and 7.

When the first and second contact-free inducers 50 and 70 are arrayed in two stages (or in multi-stage manner) within the snout 10 as illustrated in FIGS. 3 and 7, the pollutant removing apparatus 1 may include shield plates 12 perpendicular to the snout 10.

In this case, when the first and second contact-free inducers 50 and 70 apply drag force and levitation force to the zinc ash 2*a* or the dross 2*b* as a diamagnetic pollutant source, the shield plates 12 prevent the drag force and the levitation force from interfering with one another. That is, upper drag force and lower drag force may be prevented from interfering with each other, thereby preventing the zinc ash 2*a* from being scattered within the snout 10.

Although not shown, second shield plates perpendicular to the front ends of the shield plates 12 and spaced a certain distance apart from a fed steel plate may be provided to shield the steel plate from the first and second contact-free inducers 50 and 70, thereby more efficiently guiding the zinc ash 2*a* or the dross 2*b* as the pollutant source 2 to the pollutant collecting pipes 32.

Figure 8:
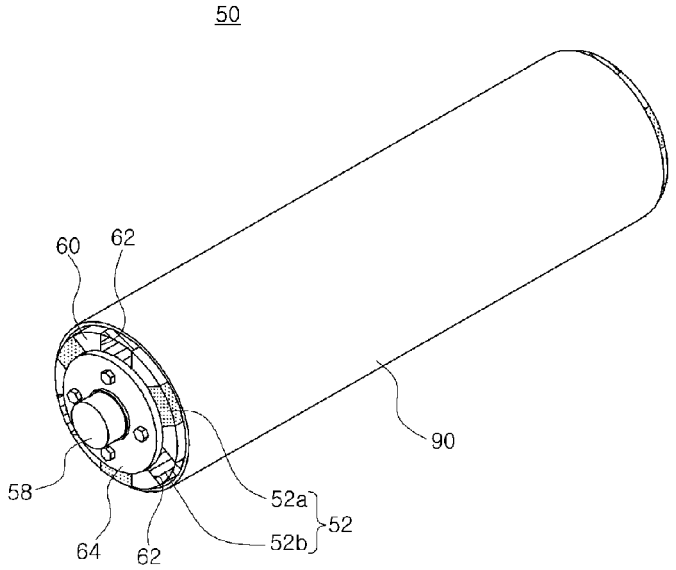
FIG. 8 is a perspective view illustrating a contact-free inducer of a pollutant removing apparatus according to an embodiment of the present invention.
Figure 9:
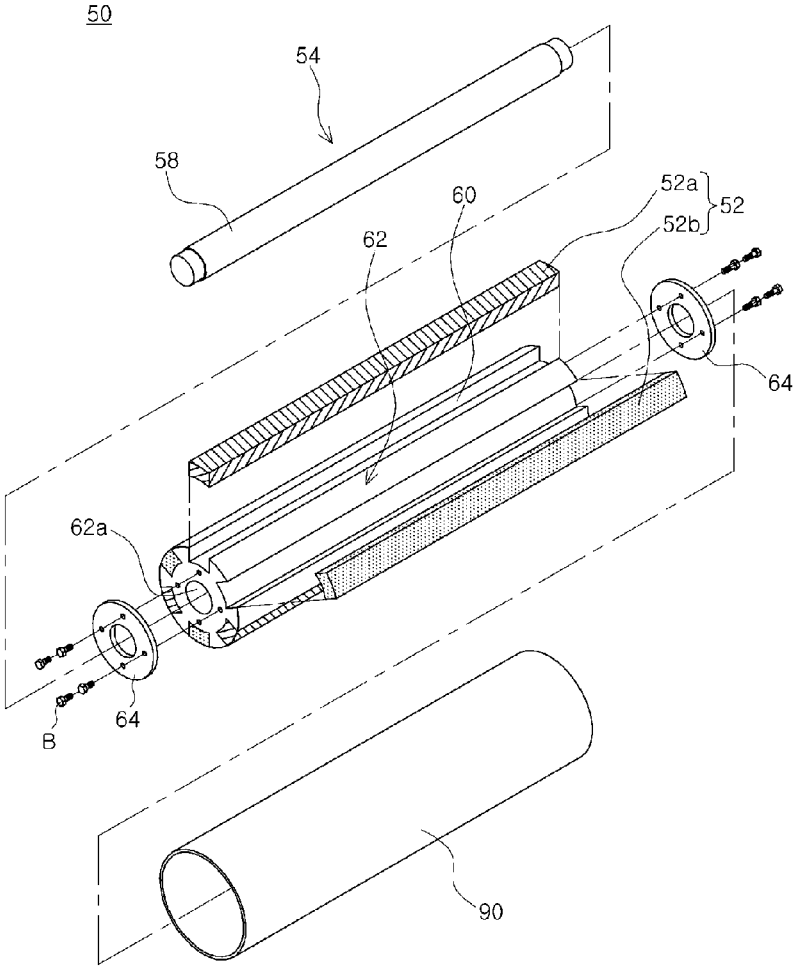
FIG. 9 is an exploded perspective view illustrating a contact-free inducer including permanent magnets according to an embodiment of the present invention.

FIG. 8 is a perspective view illustrating the first contact-free inducer 50 including the permanent magnets 52. FIG. 9 is an exploded perspective view illustrating the first contact-free inducer 50 including the permanent magnets 52. FIG. 10 is a schematic view illustrating an installed state of the first contact-free inducer 50 including the permanent magnets 52.

Referring to FIGS. 8 to 10, the N-pole permanent magnets 52*a* and the S-pole permanent magnets 52*b* are alternately arrayed around a rotator 54 to apply drag force to the pollutant source 2, thereby forcibly guiding the pollutant source 2 to the pollutant collecting pipe 32 of the pollutant collecting member 30.

Referring to FIG. 10, the second contact-free inducer 70 including the electromagnets 72 is also provided.

Referring again to FIGS. 8 and 9, the rotator 54 of the first contact-free inducer 50 includes: a rotation shaft 58 that passes through the snout 10 in the width direction of the steel plate 100, and is rotated by the driving motor 56 (refer to FIG. 10) at a side thereof; and a rotary block 62 including an assembling hole 62*a* in the center thereof, and a permanent magnet installation part 60. The rotation shaft 58 is coupled to the assembling hole 62*a*. The N-pole permanent magnets 52*a* and the S-pole permanent magnets 52*b* are alternately arrayed around the permanent magnet installation part 60.

Referring to FIG. 9, fixing plates 64 are fixed to both side portions of the rotation shaft 58 to prevent the removal of the permanent magnets 52.

Thus, referring to FIG. 10, when the driving motor 56 installed perpendicularly to the side wall of the snout 10 operates, the rotary block 62 is rotated together with the rotation shaft 58 of the rotator 54 rotated through a bearing on the side wall of the snout 10. Accordingly, the permanent magnets 52 installed on the rotary block 62 are also rotated together.

As a result, when the permanent magnets 52 rotate, time travelling magnetic flux as illustrated in FIG. 5 generates induction current to apply drag force and levitation force to the pollutant source 2, that is, to the zinc ash 2*a* and the dross 2*b* including zinc or zinc oxide as a diamagnetic substance, thereby forcibly guiding the zinc ash 2*a* and the dross 2*b* without contact.

In addition, referring to FIG. 10, the second contact-free inducer 70 including the electromagnets 72 further includes a hollow support 74 that passes through the snout 10 in the width direction of the steel plate 100. The electromagnets 72 are arrayed around the hollow support 74. Then, single-phase or three-phase alternating current is applied to the electromagnets 72 to form at least one of drag force and levitation force, thereby forcibly guiding the zinc ash 2*a* or the dross 2*b* as the pollutant source 2, to the pollutant collecting pipe 32.

That is, unlike the first contact-free inducer 50, the second contact-free inducer 70 including the electromagnets 72 does not rotate, and connects to the pulse width modulator 78 through the electromagnets 72 (stacked in a multi-layer as illustrated in FIG. 5) and a cable 76 within an inner space 74*a* of the hollow support 74, so that proper alternating current can be applied to the electromagnets 72.

As described above with reference to FIGS. 3 and 10, a passing speed of a steel plate, the driving motor 56, and the pulse width modulator 78 can be controlled by sensing a collected amount of the zinc ash 2*a* or the dross 2*b*. For example, a rotation speed of the rotator 54 (refer to FIG. 9) of the first contact-free inducer 50 may be set according to a steel plate passing speed (line speed) of a plating process, and the flow rate sensor 40 (refer to FIG. 3) may sense a collected amount of the zinc ash 2*a* or the dross 2*b* as the pollutant source 2 formed of zinc oxide collected at a position forwardly spaced about 200 m from a welding position of a continuous steel plate. Accordingly, a pollutant collecting pressure can be properly maintained.

Thus, the pollutant removing apparatus 1 properly applies drag force and levitation force to the pollutant source 2 including the zinc ash 2*a* or the dross 2*b* to forcibly guide (drag) the pollutant source 2 without contact, thereby maximizing pollutant source removing efficiency with minimum collecting force.

That is, according to the embodiment, cost increase due to an excessive pollutant collecting process, or inefficient atmospheric state within a snout can be prevented.

Moreover, according to the present embodiment, the zinc ash 2*a* or the dross 2*b*, that is, a pollutant source of a steel plate or a unit such as a sink roll, can be effectively prevented from affecting a plating process or polluting a unit. As a result, the plating quality of a steel plate can be improved, and processing units can be maintained to be clean to thereby increase the service life thereof.

To this end, the insulating cover 90 formed of ceramic may be disposed at least around the rotator 54 of the first contact-free inducers 50 as illustrated in FIGS. 8 and 9. Particularly, the insulating cover 90 may be fixed within the side wall of the snout 10 and be spaced a certain distance apart from the periphery of the rotator 54 to effectively remove attached zinc particles, and efficiently form drag force.

While the present invention has been shown and described in connection with the exemplary embodiments, it will be apparent to those skilled in the art that modifications and variations can be made without departing from the spirit and scope of the invention as defined by the appended claims.

Industrial Applicability

According to the above embodiment, an induction current is used to apply drag force and levitation force to zinc ash including zinc or zinc oxide as a diamagnetic substance, or to dross formed on the surface of a plating solution, thereby efficiently removing a pollutant source from a steel plate or a processing unit. In addition, the pollutant source can be properly collected, and an inner atmospheric condition of a snout can be stably maintained. As a result, zinc ash or dross can be effectively prevented from affecting a steel plate plating process, and polluting processing units.

The invention claimed is:

1. A pollutant removing apparatus comprising:

at least one pollutant collecting member connecting to a snout between a heating furnace and a plating tank; and a contact-free inducer varying a magnetic field within the snout to forcibly guide a pollutant source of a steel plate or a processing unit to the pollutant collecting member, wherein the contact-free inducer comprises a rotation shaft which passes through the snout in a width direction of a steel plate and is rotated by a driving motor and a rotary block coupled to the rotation shaft and comprising a permanent magnet installation part on which permanent magnets having different poles are alternately installed, and wherein the permanent magnets installed on the rotary block are rotated together with the rotation shaft, and forcibly guide the pollutant source within the snout to the pollutant collecting pipe of the pollutant collecting member.

2. The pollutant removing apparatus of claim 1, wherein the pollutant source comprises zinc or zinc oxide as a diamagnetic substance to which at least one of drag force and levitation force according to induction current generated by the rotation of the permanent magnets of the contact-free inducer is applied, and wherein the pollutant collecting member comprises a pollutant collecting pipe connected to the snout, and a suction line connected to the pollutant collecting pipe.

3. The pollutant removing apparatus of claim 1, wherein the contact-free inducer is adjacent to a pollutant collecting pipe of the pollutant collecting member connected to the snout, and is disposed on at least one side of a fed steel plate to forcibly guide at least one of zinc ash and dross as the pollutant source within the snout to the pollutant collecting pipe.

4. The pollutant removing apparatus of claim 1, wherein the-contact-free inducer is adjacent to a pollutant collecting pipe of the pollutant collecting member connected to the snout, and is provided in plurality in a multi-stage on at least one side of a fed steel plate to forcibly guide at least one of zinc ash and dross as the pollutant source within the snout to the pollutant collecting pipe.

5. The pollutant removing apparatus of claim 4, wherein the contact-free inducer disposed at least in a lower stage of the multistage is adjacent to a surface of a plating solution, or is partially immersed in the plating solution to forcibly guide at least the dross as the pollutant source within the snout to the pollutant collecting pipe.

6. The pollutant removing apparatus of claim 1 further comprising a second contact-free inducer that comprises electromagnets to which single-phase or three-phase alternating current is applied to form time travelling magnetic flux, to forcibly guide at least one of zinc ash and dross as the pollutant source within the snout to the pollutant collecting member.

7. The pollutant removing apparatus of claim 6, wherein the second contact-free inducer comprises:

a hollow support passing through the snout in a width direction of a steel plate, the electromagnets being arrayed around the hollow support; and a pulse width modulator connected to the electromagnets through a cable within the hollow support.

8. The pollutant removing apparatus of claim 1, further comprising an insulating cover surrounding the contact-free inducer with a certain space therebetween to protect the contact-free inducer from a steel plate or a processing unit.

9. The pollutant removing apparatus of claim 4, further comprising at least a first shield plate connected to the snout between the contact-free inducers disposed in a multi-stage manner within the snout, and further comprising a second shield plate disposed at an end of the first shield plate and extending in a passing direction of a steel plate.

10. The pollutant removing apparatus of claim 6, wherein a suction line of the pollutant collecting member is provided with a flow rate sensor that senses a flow rate of a collected pollutant source, and that connects to an apparatus control unit, and wherein the apparatus control unit is connected to a driving motor adjacent to the contact-free inducer and a pulse width modulator adjacent to the second contact-free inducer, and wherein the driving motor and the pulse width modulator control an operation of the contact-free inducer and the second contact-free inducer, respectively, based on a collected amount of the pollutant source.

* * * * *